United States Patent [19]

Vinch et al.

[11] 4,194,804

[45] Mar. 25, 1980

[54] WIRE RETAINING FINGER

[75] Inventors: Angelo N. Vinch, Warren; Anthony G. Schad, Troy, both of Mich.

[73] Assignee: Westinghouse Electric Corp., Pittsburgh, Pa.

[21] Appl. No.: 736,293

[22] Filed: Oct. 28, 1976

Related U.S. Application Data

[63] Continuation of Ser. No. 576,933, May 12, 1975, abandoned.

[51] Int. Cl.[2] ..... H01R 9/22; H01R 13/58

[52] U.S. Cl. ..... 339/103 M; 174/72 A; 339/198 R

[58] Field of Search ..... 339/103-106, 339/198 R, 198 J, 198 K; 174/72 A; 317/118, 122

[56] References Cited

U.S. PATENT DOCUMENTS

| | | | |
|---|---|---|---|
| 1,639,310 | 8/1927 | Richardson | 339/198 R |
| 3,411,043 | 11/1968 | Cobaugh | 174/72 A |
| 3,764,958 | 10/1973 | Teagno et al. | 339/105 |
| 3,906,146 | 9/1975 | Taylor | 174/72 A |

FOREIGN PATENT DOCUMENTS

| | | | |
|---|---|---|---|
| 900485 | 10/1944 | France | 339/105 |
| 604078 | 6/1948 | United Kingdom | 339/103 R |

*Primary Examiner*—Joseph H. McGlynn
*Attorney, Agent, or Firm*—M. J. Moran

[57] ABSTRACT

An electrically insulating bent finger having the characteristic shape of the letter J is utilized in conjunction with a terminal block to provide a wire duct section. The fingers are spaced along a portion of the terminal block with the bite piece facing inward toward the terminal block. Consequently the bottom portion of the J shape acts as one side of the wire duct, the vertical portion of the J shape acts as the bottom of the wire duct and the terminal block itself acts as the other side of the wire duct. The fingers may be inserted after the wiring of the terminal block has been completed.

4 Claims, 4 Drawing Figures

WIRE RETAINING FINGER

CROSS-REFERENCE TO RELATED APPLICATIONS

This is a continuation of application Ser. No. 576,933 filed May 12, 1975, now abandoned.

Certain aspects of the invention taught in this application are related to inventions taught in copending application Ser. No. 576,910, filed May 12, 1975 now abandoned filed concurrently by A. N. Vinch and P. G. Muckenthaler and assigned to the assignee of the present invention.

BACKGROUND OF THE INVENTION

This invention relates generally to wire duct and in particular to prefabricated wire duct for utilization in conjunction with terminal blocks.

It is known to provide wire duct or wire channel for use in electrical apparatus. Typically the wire duct has the cross-sectional shape of the letter "U". This provides a trough of electrically insulating material having no integral top enclosing portion. The runs of wire are laid in the trough and taken to appropriate places on the electrical apparatus to be served thereby. In the case of electronic circuitry or computer circuitry relatively thin insulated wire is disposed in troughs of the kind previously described. Typically long vertical and horizontal runs of wire are neatly and orderly maintained even in a relatively complex electronic application or computer application when utilizing this type of apparatus. A longitudinal side section of the wire duct shows numerous spaced cutouts. Often there is as much open space as side portion in wire duct of this kind. The opened side spaces are utilized to feed wires out of and into the wire duct for utilization in the electronic or electrical circuitry for which the wire is provided. Often the wire duct assembly is finished by providing a cap or elongated strip of material over the top of the "U". One of the problems associated with this kind of installation or apparatus lies in the fact that the wires must be delicately fed into and out of the wire duct and provided to the terminal boards associated with the electronic circuitry which utilizes the wiring during fabrication. Often the wire duct is large and cumbersome and becomes an obstacle to completing the wiring task because it is in the way of wiremen who are attempting to fasten down the ends of the wire on screw-type terminal blocks. Another disadvantage lies in the fact that removal of a portion of the wire duct for any reason after wiring has begun usually necessitates completely removing the wires which are disposed therein and then removing the entire wire duct section as the sections tend to be unitary. Another disadvantage lies in the fact that a large amount of electrically insulating material (often petroleum or coal base) is needed to construct a wire duct according to the prior art. It would be advantageous if high quality electrically insulating wire duct could be provided which does not significantly interfere with the wiremen's operation during the wiring process, which involves a minimum use of costly and expensive materials which are often in short supply, which makes maximum use of available material which is present for other reasons and which can be easily replaced if broken.

SUMMARY OF THE INVENTION

In accordance with the invention a wire retaining finger is taught for utilization in conjunction with a terminal block. Because of this the terminal block acts as part of a wire duct structure. This provides for an economic utilization of material. In addition, since the fingers are unitary and are detachably fastened to the block a single finger can be removed and easily replaced if the need arises. In addition, since the fingers are detachable, the wiring operation in the vicinity of the terminal block can be completed before the wire duct fingers are inserted. This of course provides more space for a wireman to work. In one embodiment of the invention electrical apparatus is taught which is interconnectable with an electrical conductor. This apparatus comprises terminal means for connecting wires or conductors to the apparatus and retainer means which is disposed upon the terminal means. The retainer means structurally cooperates with the terminal means to form a partially enclosed region across which the conductor extends for providing physical control of the conductor. The physical control often takes the form of support for the conductor. In other instances the physical control takes the form of channeling for the conductor. In another utilization of the invention the permissible range of movement of the conductor is limited by the combined utilization of the terminal means and the retainer means. In another embodiment of the invention the retainer means is detachable from the terminal means. In still another embodiment of the invention the terminal means comprises an elongated terminal block which is electrically insulating and the retainer means comprises a plurality of retaining members disposed in spaced relationship along the insulating member. In another embodiment of the invention an elongated terminal board is disclosed to which are attached a plurality of retaining fingers which are spaced longitudinally along the terminal board. The retaining fingers cooperate with adjacent portions of the terminal board to form a wire duct which is useful for physical controlling the flexible conductors which are attached to the terminals of the terminal board. In still another embodiment of the invention a wire duct apparatus is taught comprising a base means and a retainer means which is detachably attached to the base means.

BRIEF DESCRIPTION OF THE DRAWINGS

For a better understanding of the invention reference may be had to the preferred embodiments exemplary of the invention shown in the accompanying drawings in which.

DESCRIPTION OF THE PREFERRED EMBODIMENTS

Figure 1:
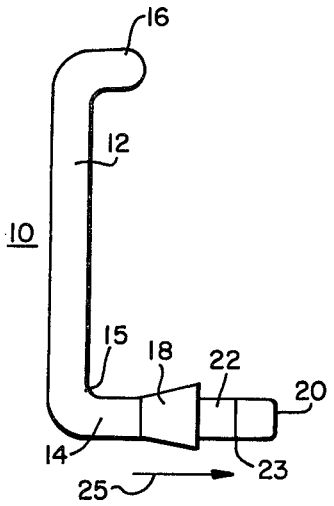
FIG. 1 shows a side elevation of a retaining finger.

Referring now to the drawings and FIG. 1 in particular, a retaining finger 10 is shown. Retaining finger 10 comprises a bottom portion 12 with a lip 16 on one side thereof and an elongated portion 14 on the other side thereof. The elongated portion 14 is generally parallel to the lip portion 16. The elongated portion 14 generally forms a right angle with the bottom portion 12 at the region 15. Consequently, it may be said that the finger or retainer 10 has a characteristic shape of a right angle at one region thereof. The elongated portion 14 may have a stop or widened portion 18 disposed thereon. Disposed at the end of the elongated portion 14 is a locking or fastening portion 20. The locking or fastening portion 20 may have an indented portion 22 and a barb or raised portion 23. During an assembly operation the entire assembly 10 may be pushed into a base or other solid means to be shown hereinafter in the direction 25. The locking portion 20 protrudes into the base (not shown) such that the recessed portion 22 is securely held in the base between the barb 23 and the stopping or abutting portion 18.

Figure 2:
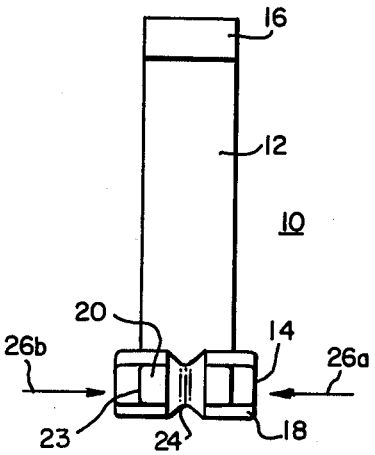
FIG. 2 shows a top view of the retaining finger of FIG. 1.

Referring now to FIG. 2, a top view of the finger or retainer 10 is shown. The bottom portion 12 is shown disposed between the elongated riser 14 on one side thereof and the shortened lip 16 on the other side thereof. Disposed on the elongated riser 14 is the widened stopping portion 18 above which is disposed the interlocking member 20. Centrally disposed in the interlocking member 20 is a V-shaped cutout 24 which will be more clearly shown with respect to FIG. 3. As the retainer 10 is disposed in the base the interlocking portion 20 is compressed as indicated by the arrows **26*a* and 26*b* to reduce the angle of the previously described wedge 24 such that the lip 23 may clear that portion of the base through which it must feed for locking. Once the lip or barb 23 is free of the opening in the base the tension of the portion 20 is such that the angle of the wedge expands so that the movement of the locking portion 20 is opposite to the directions of the arrows 26*a* and 26*b*. This provides firm locking of the member 10** in the base.

Figure 3:
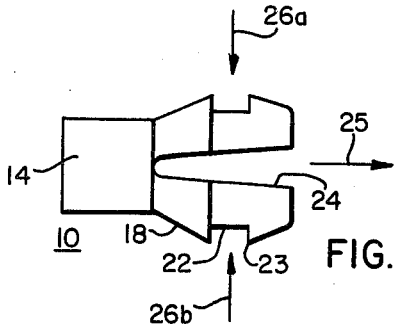
FIG. 3 shows a front view of the retaining finger of FIG. 1.

Referring now to FIG. 3 the operation and construction of the finger 10 can be even more clearly understood. The elongated vertical riser 14 is shown with the widened abutting or stopping piece 18 disposed approximately halfway up the riser 14 and the interlocking member 20 disposed at the end of the member 14. The V-shaped wedge 24 is clearly shown between the right and left portions of the member 20. The barb 23 is shown disposed above the recessed opening 22 which in turn is above the upward edge of the abutting or stopping member 18. As the finger assembly is moved in the direction 25 into contact with a base or similar member it must clear an opening in the base. This causes the members 20 to compress in the directions **26*b* and 26*a* due to the absence of solid material in the region of the wedge 24. As the barb 23 passes the clearance region the members 20 expand or move outwardly in opposite directions from the arrows 26*a* and 26*b* to thus firmly interlock the member 10 onto a wall or similar portion of a supporting base in the region of the recess 22 between the barb 23 and the widened portion of the abutting or stopping member 18. To remove the member 10 compression may be exerted against the sides of the stopping member 18 thus narrowing the angle of the wedge 24 thus providing clearance for the barb 23 so that the apparatus 10 may be moved in the direction opposite to 25**.

Figure 4:
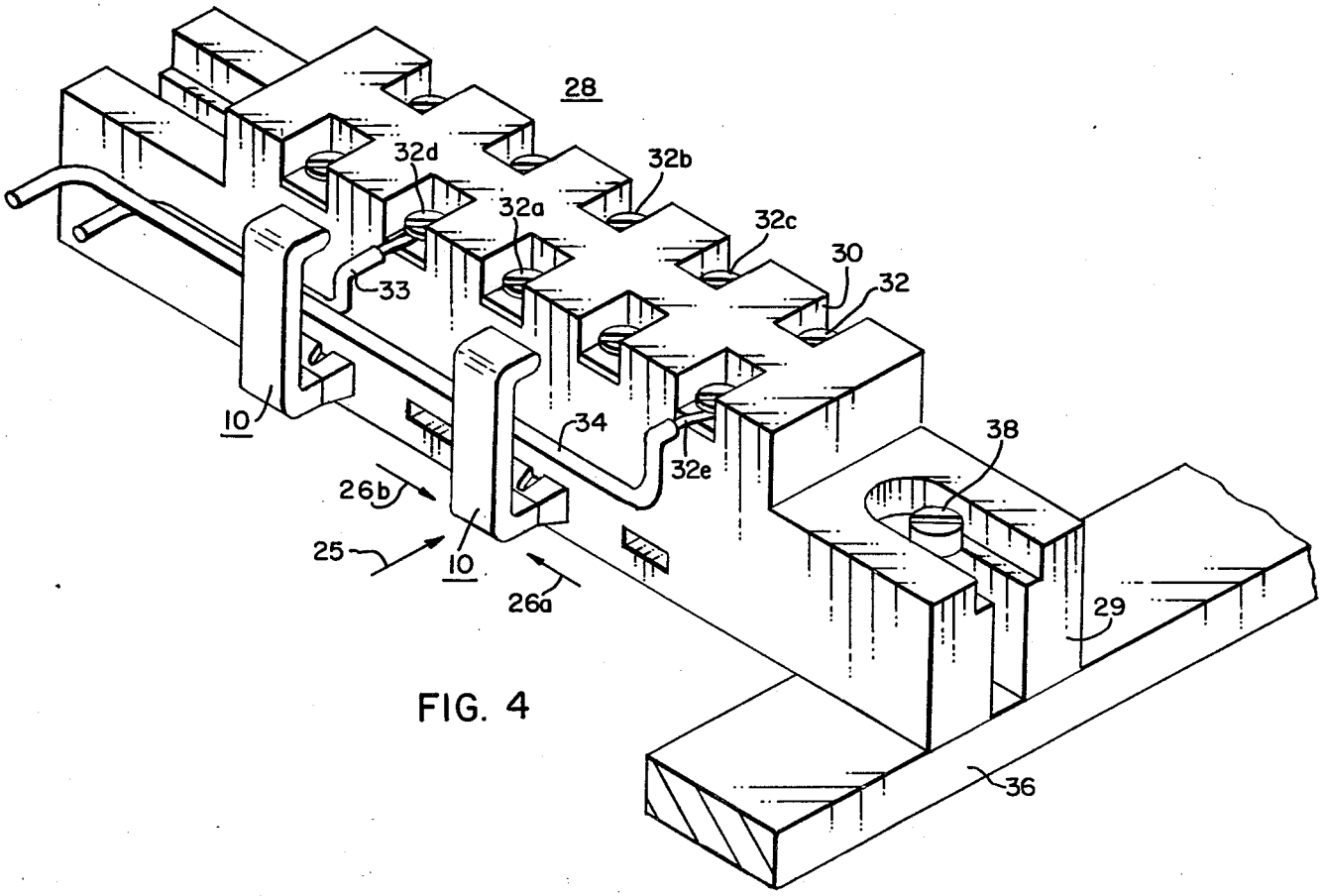
FIG. 4 shows a terminal block utilizing the retaining finger of FIG. 1.

Referring now to FIG. 4, an assembled combination terminal board and bus duct apparatus 28 is shown. The combination terminal block and bus duct 28 may comprise an elongated or electrically insulating terminal block member or means 29 having recesses 30 therein in which are disposed electrical terminal assemblies 32. Electrical continuity may exist in the terminal block between terminals **32*a* and 32*b*, for example, but generally does not exist between terminals 32*b* and 32*c*, for example. Consequently, electrical continuity between wires may exist across the terminal block but not longitudinal thereto or no continuity may exist between any terminals but may be provided externally. In this embodiment of the invention two wires 33 and 34 are shown electrically interconnected with terminal members 32*d* and 32*e* respectively. The terminal board may be secured to a support means 36 by way of a securing screw 38, one of which is shown at the end of the terminal block assembly 28. Two of the previously described fingers or retainers 10 are shown disposed in cooperating disposition with the terminal block 29. The fingers cooperate with the block 29 in such a manner that the wires 33 and 34 traverse the region between the finger 10 and the terminal block 29 in each case so that the wire may be supported by the finger or member 10, and/or may be limited in movement by the constraints imposed thereupon by the finger 10 and the side of the terminal block 29 and/or may be tied down upon the finger 10 if that is desired. The general direction of compression 26*a* and 26*b* of a member 10 is shown as well as the direction 25. The members 10 are disposed in the member 29 by moving the finger 10 in the direction 25**.

It is to be understood with respect to the embodiments of this invention that the member 10 may be cast or molded as an integral part of the terminal block 29 if that is desired. Also the member 10 may be detachably attachable to the terminal block 29 as was previously discussed with respect to FIGS. 1 through 3. In addition, the fingers 10 may be attached after the wiring operation is completed or before the wiring operation is completed if that is desirable. It is also to be understood that the finger 10 may be utilized on a terminal block such as 29 but may also be used on other electrical apparatus requiring bus duct type wiring restriction and constraints. As an example, one of the fingers 10 shown in FIG. 4 may be removed from the terminal block 29 and utilized elsewhere in a separate completely different type of assembly which is prepared for acceptance of a finger 10. The fingers 10 shown in FIG. 4 may be interchanged with each other. If desired one of the fingers 10 may be removed and replaced by another, should for example one of the fingers 10 be broken. It is also to be understood with respect to the embodiments of this invention that the number of fingers 10 shown in FIG. 4 is not limiting. More fingers may be utilized or even one finger may be utilized if that is desired. Other means of installation of finger 10 may include but is not limited to gluing, cementing or twisting if that is desired. Generally the fingers 10 shown in FIG. 4 are aligned longitudinally and in an identical manner along the length of the terminal block 29. The previous arrangement is not limiting. In addition, the relative length of the portions 12, 14 and 16 are not limiting. As an example the lip portion 16 may be longer or may be completely missing from the apparatus. It is also to be understood that the "J"-shaped or "U"-shaped construction of the finger 10, such as shown in FIG. 1, is not limiting. The characteristic shape generally associated with the members 12, 14 and 16 of FIG. 1 may be replaced by a gently arcuate portion having the characteristic shape of a semicircle, for example. It is also to be understood that the apparatus upon which the combination terminal block retaining member may be utilized may include a programmable controller or the control system for a circuit breaker or the wire terminals for a computer.

The apparatus taught in this invention has many advantages. One advantage lies in the fact that the wire duct apparatus provides for an economy of parts by utilizing a portion of the terminal board, such as 29 shown in FIG. 4 for forming part of the wire duct. Another advantage lies in the fact that separate portions of the wire duct such as fingers 10 may be removed from portions of the terminal block 29 without necessitating unwiring the terminal block and removing all of the wire duct apparatus. Another advantage lies in the fact that the terminal block wire duct apparatus 28 may be wired or connected by a wireman, such as at terminals 32*d* and 32*e*, for example, before the members 10 are inserted. This provides more space for the wireman to accomplish his wiring operation. Another advantage lies in the fact that the combination of the terminal block and wire duct apparatus 28 takes up less space than a separate single terminal block and a separate prior art wire duct apparatus utilized together. Another advantage lies in the flexibility of spacing the wire duct fingers 10 along the terminal board 29 at different intervals. As an example, they may be spaced closer than is shown in FIG. 4 or further apart.

What we claim as our invention:

1. Electrical apparatus which is interconnectable with an electrical conductor, comprising:

(a) an elongated terminal board having a flat side surface and a flat front surface which is angularly disposed from said side surface; and (b) a plurality of retaining fingers each of which is independently detachably attached to and spaced longitudinally along said side surface of said terminal board, said retaining fingers and adjacent portions of said side surface of said terminal board structurally cooperating to form partially enclosed regions which are perpendicular to the plane of said side surface and the plane of said front surface and through which said conductor is extendable for channeling said conductor, said terminal board having terminals along said front surface for connection with said conductor.

2. The combination as claimed in claim 1 wherein said front surface is generally angularly disposed by 90 degrees from said side surface.

3. The combination as claimed in claim 1 wherein said fingers are relatively flexible.

4. The combination as claimed in claim 1 wherein said fingers comprise electrically insulating material.

* * * * *